US008356566B1

(12) United States Patent
Sellins

(10) Patent No.: US 8,356,566 B1
(45) Date of Patent: Jan. 22, 2013

(54) MULTI-DIRECTIONAL MARINE PROPULSOR APPARATUS

(76) Inventor: David Alan Sellins, North Stonington, CT (US)

( * ) Notice: Subject to any disclaimer, the term of this patent is extended or adjusted under 35 U.S.C. 154(b) by 0 days.

(21) Appl. No.: 13/417,447

(22) Filed: Mar. 12, 2012

Related U.S. Application Data

(60) Provisional application No. 61/454,385, filed on Mar. 18, 2011.

(51) Int. Cl.
*B63H 25/06* (2006.01)

(52) U.S. Cl. ..... 114/166; 440/43

(58) Field of Classification Search ..... 114/166, 114/151; 440/40–43, 39, 37, 49; 137/876; 416/93 A, 244
See application file for complete search history.

(56) References Cited

U.S. PATENT DOCUMENTS

| | | | | | |
|---|---|---|---|---|---|
| 368,678 | A | | 8/1887 | McDougall | |
| 1,130,153 | A | | 3/1915 | Dennis | 440/14 |
| 1,344,518 | A | | 6/1920 | Rees | |
| 2,043,276 | A | | 6/1936 | Wellons | 114/162 |
| 2,076,603 | A | | 4/1937 | Svendsen | 440/51 |
| 2,091,677 | A | * | 8/1937 | Fredericks | 416/189 |
| 2,684,635 | A | | 7/1954 | Winkelman | 415/116 |
| 3,116,602 | A | * | 1/1964 | Dahle | 440/43 |
| 3,248,876 | A | | 5/1966 | Parsons | 60/35.54 |
| 3,534,703 | A | | 10/1970 | Ekman | 440/50 |
| 3,823,684 | A | * | 7/1974 | Baggs | 440/43 |
| 3,901,177 | A | | 8/1975 | Scott | 115/41 |
| 3,995,579 | A | | 12/1976 | Childre | 440/7 |
| 4,214,544 | A | | 7/1980 | Dashew et al. | 114/151 |
| 4,223,625 | A | | 9/1980 | Puretic | 114/147 |
| 4,423,696 | A | | 1/1984 | Aker | 114/148 |
| 4,741,676 | A | | 5/1988 | Janes | 417/362 |
| 4,807,552 | A | | 2/1989 | Fowler | 114/151 |
| 4,813,895 | A | | 3/1989 | Takahashi | 440/41 |
| 5,016,553 | A | | 5/1991 | Spencer | 114/151 |
| 5,090,347 | A | | 2/1992 | Radi | 114/145 |
| 5,282,763 | A | | 2/1994 | Dixon | 440/42 |
| 5,558,036 | A | | 9/1996 | Hara | 114/249 |
| 5,642,684 | A | | 7/1997 | Aker | 114/151 |
| 6,561,860 | B2 | | 5/2003 | Colyvas | 440/61 |
| 6,579,133 | B1 | | 6/2003 | Harris | 440/7 |
| 6,599,158 | B2 | | 7/2003 | Shidara | 440/1 |
| 6,602,054 | B1 | | 8/2003 | Sherman | 416/99 |
| 6,733,351 | B2 | | 5/2004 | Mashiko | 440/88 A |
| 6,976,444 | B1 | | 12/2005 | Seiford, Sr. | 114/144 |
| 7,004,803 | B2 | | 2/2006 | Ruffe | 440/53 |
| 7,500,890 | B2 | | 3/2009 | Morvillo | 440/41 |
| 7,721,665 | B2 | | 5/2010 | Schreiber | 114/163 |

(Continued)

*Primary Examiner* — Edwin Swinehart
(74) *Attorney, Agent, or Firm* — The Patent Source

(57) ABSTRACT

Multi-directional marine propulsors for use with boats having a hull, a keel and a motor with a propeller are disclosed. The propulsor may have a cylindrical housing with fore, aft, port and starboard apertures and define a central axis when the housing is mounted to the boat. The housing may receive the propeller proximate the fore aperture such that the propeller may rotate about the central axis to provide forward thrust. An elliptical diverter gate may be mounted within the housing proximate the aft aperture for vertical rotation between port, central and starboard positions. When the gate is in port, central and starboard positions, forward thrust may exit the port, central and starboard apertures respectively. The elliptical diverter gate may be rotated between the port, central and starboard positions as desired. Alternative multi-directional marine propulsors may be mounted directly onto boat motors.

20 Claims, 6 Drawing Sheets

U.S. PATENT DOCUMENTS

| | | | | |
|---|---|---|---|---|
| 7,789,032 | B1 | 9/2010 | McDugle et al. | 114/151 |
| 2005/0164570 | A1 | 7/2005 | Colyvas | 440/39 |
| 2008/0141652 | A1 | 6/2008 | Lazar | 60/204 |
| 2009/0004934 | A1 | 1/2009 | Roshong | 440/49 |
| 2009/0173268 | A1 | 7/2009 | Morvillo | 114/151 |
| 2010/0151751 | A1 | 6/2010 | Jemt | 440/14 |
| 2010/0310357 | A1 | 12/2010 | Papageorgion | 415/90 |

* cited by examiner

MULTI-DIRECTIONAL MARINE PROPULSOR APPARATUS

CROSS REFERENCE TO RELATED CASES

This application claims the benefit under 35 U.S.C. 119(e) of co-pending U.S. Provisional Application Ser. No. 61/454,385, filed Mar. 18, 2011 and entitled "Turbo-Ellor propulsor—Provides forward, aft, and side to side thrust, as propulsion for boats maneuvering in tight dock areas or anchorages"; which Provisional Application is hereby incorporated by reference in its entirety.

BACKGROUND OF THE INVENTION

1. Field of the Invention

The present invention is directed to multi-directional marine propulsors. More particularly, the invention relates improvements in marine propulsors that provide fore, aft, and side to side thrust to improve boat maneuverability. Accordingly, the general objects of the invention are to provide novel methods and apparatus of such character.

2. Description of the Related Art

Maneuvering boats in tight conditions such as in docking, mooring, dangerous narrow channels and/or anchorage areas has been necessary as long as there have been boats. Naturally, various solutions to such problems have been devised and applied to various types of boats and ships including many solutions for specialized needs. These prior art solutions have included systems that employ auxiliary power sources such as bow side thrusters and/or stern mounted side thrusters as a supplement to the primary drive means. Obvious downsides to such efforts include increased costs, increased equipment maintenance, increased complexity, expensive installations and/or added hole penetrations through the boat hull. Integral (unitary) multi-directional propulsors have also been devised to solve some of these problems. However, room for improvements remain.

It is therefore, a primary object of the present invention to provide improvements in marine propulsor apparatus which overcome the disadvantages associated with earlier types of such apparatus.

SUMMARY OF THE INVENTION

In one form, the present invention satisfies the above-stated needs and overcomes the above-stated and other deficiencies of the related art by providing a multi-directional marine propulsor apparatus for use with a boat of the type having a hull, a keel defining a bow-stern axial direction and a motor with a rotatable propeller. The propulsor may have a cylindrical thruster housing with opposing fore and aft apertures and with opposing port and starboard apertures. The housing may define a central axis at least substantially parallel to the bow-stern axial direction when mounted in fixed relation to the boat hull. The housing may also be sized to receive the propeller proximate to the fore aperture such that the propeller may rotate about the central axis to thereby provide forward thrust within the housing. In addition to the housing, the propulsor may include some means for affixing the cylindrical housing to the boat and an elliptical diverter gate mounted within the cylindrical housing proximate the aft aperture for limited rotation about a vertical control axis between port, central and starboard positions. When the gate is in a port position substantially all of the forward thrust may exit the port aperture. When the gate is in a central position substantially all of the forward thrust may exit the aft aperture. When the gate is in a starboard position substantially all of the forward thrust may exit the starboard aperture. The inventive propulsor may also include some means for rotating the diverter gate between the port, central and starboard positions.

In a related form, the invention provides a multi-directional marine propulsor apparatus for use with a boat motor having a rotatable propeller. The propulsor may include a cylindrical thruster housing with opposing fore and aft apertures and with opposing port and starboard apertures. The housing may define a central axis when mounted in fixed relation to the boat motor and may be sized to receive the propeller proximate the fore aperture such that the propeller may rotate about the central axis within the housing to thereby provide forward thrust within the housing. The propulsor may also include some means for affixing the cylindrical housing to the motor and an elliptical diverter gate mounted within the cylindrical housing proximate the aft aperture for limited rotation about a vertical control axis between port, central and starboard positions. When the gate is in a port position substantially all of the forward thrust may exit the port aperture. When the gate is in a central position substantially all of the forward thrust may exit the aft aperture. When the gate is in a starboard position substantially all of the forward thrust may exit the starboard aperture. The inventive propulsor may also include some means for rotating the diverter gate between the port, central and starboard positions.

Numerous other advantages and features of the present invention will become apparent to those of ordinary skill in the art from the following detailed description of the preferred embodiments, from the claims and from the accompanying drawings.

BRIEF DESCRIPTION OF THE DRAWINGS

The preferred embodiments of the present invention will be described below with reference to the accompanying drawings where like numerals represent like steps and/or structures and wherein.

DETAILED DESCRIPTION OF THE PREFERRED EMBODIMENTS

Figure 1A:
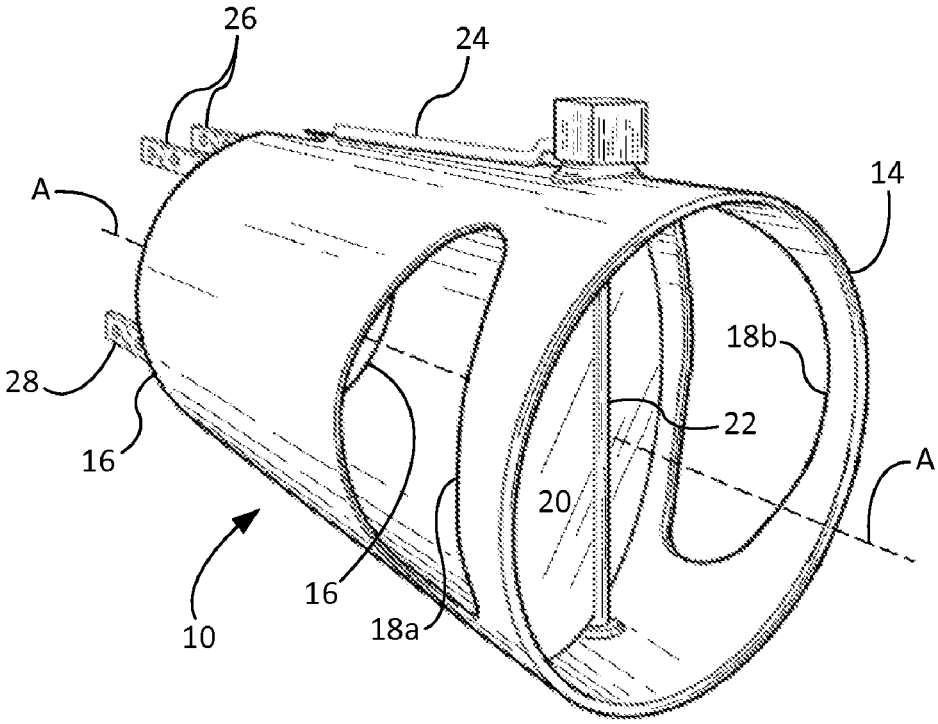
FIG. 1A is a perspective view of a multi-directional propulsor apparatus in accordance with one preferred embodiment of the present invention.
Figure 1B:
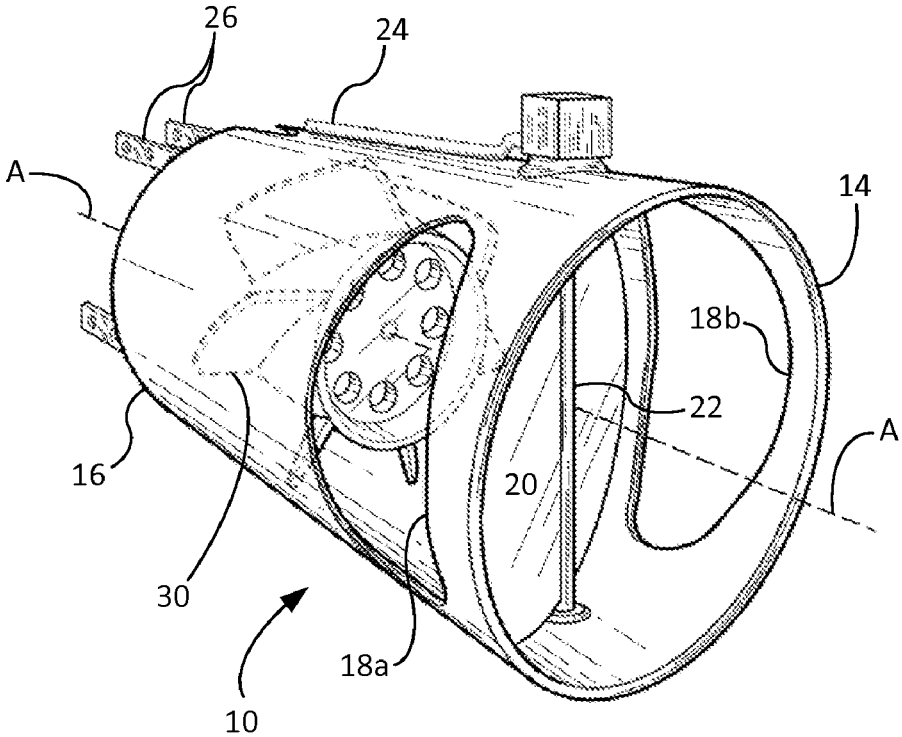
FIG. 1B is a perspective view of the propulsor apparatus of FIG. 1A shown with an axially aligned turbine disposed therein.
Figure 2A:
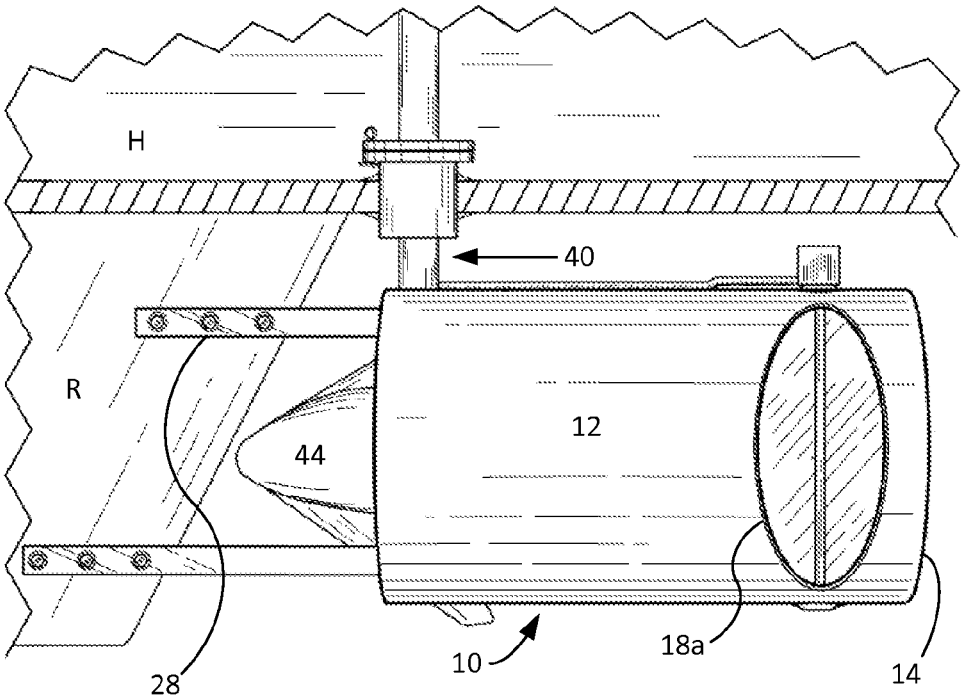
FIG. 2A is a side elevation view of the preferred propulsor apparatus of FIG. 1A after having been installed on a boat.
Figure 2B:
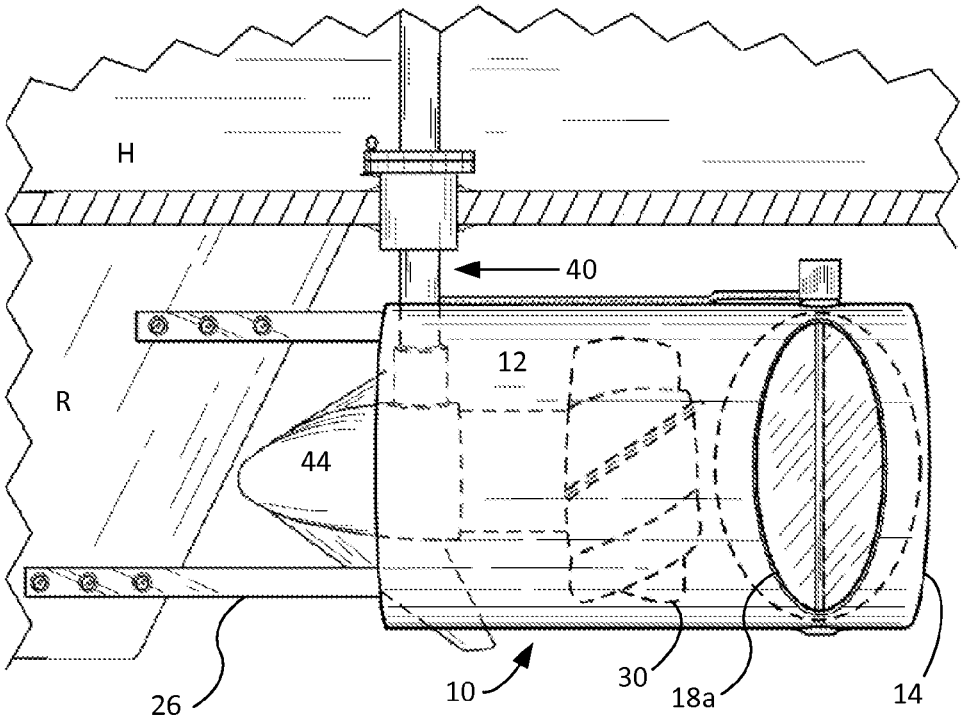
FIG. 2B is a side elevation view of the preferred propulsor apparatus of FIG. 1A after having been installed on a boat wherein some of the hidden details have been shown in dashed lines.
Figure 3:
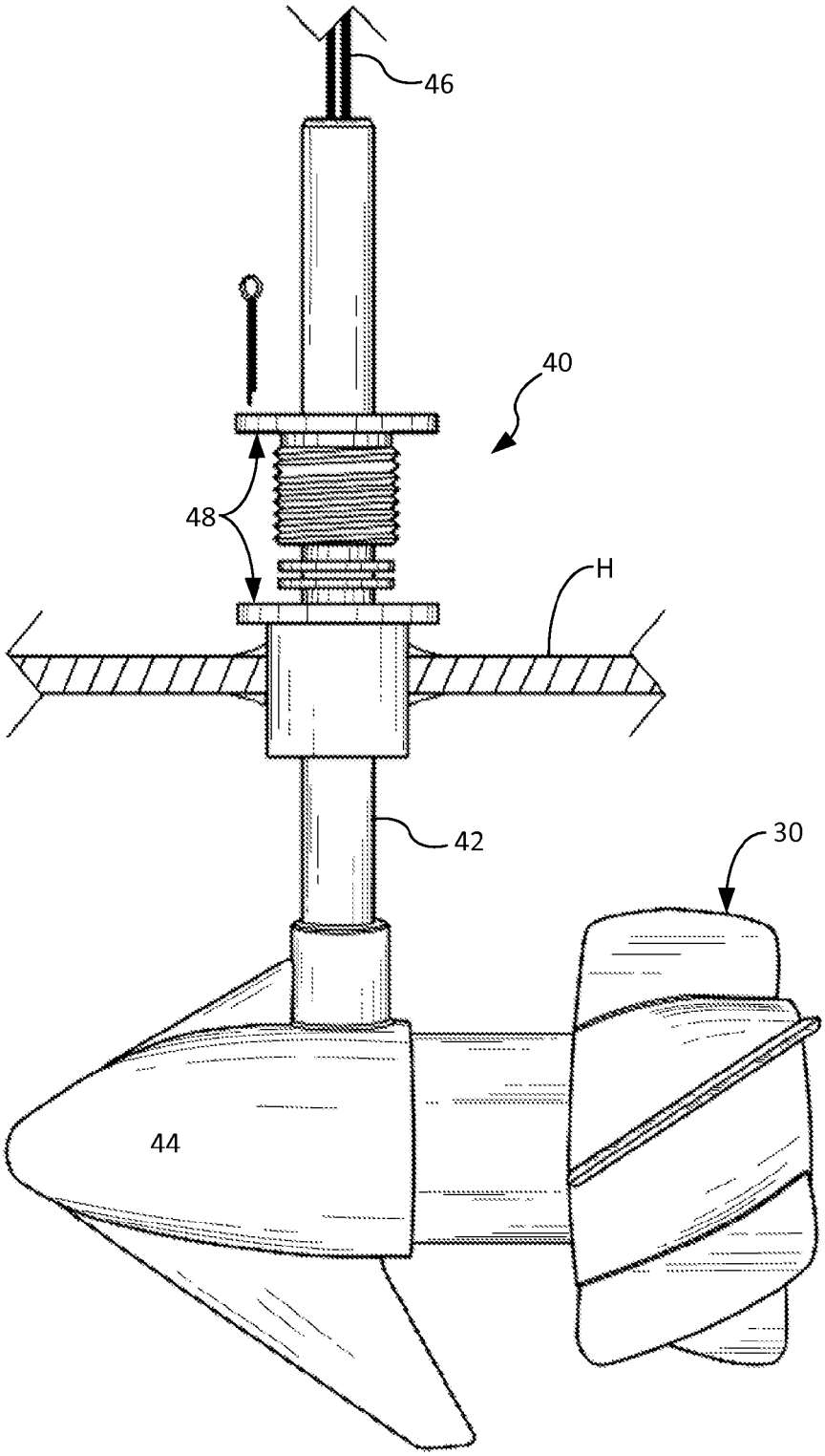
FIG. 3 is a side elevation view of a prior art boat motor with an inventive turbine/propeller installed thereon.
Figure 4:
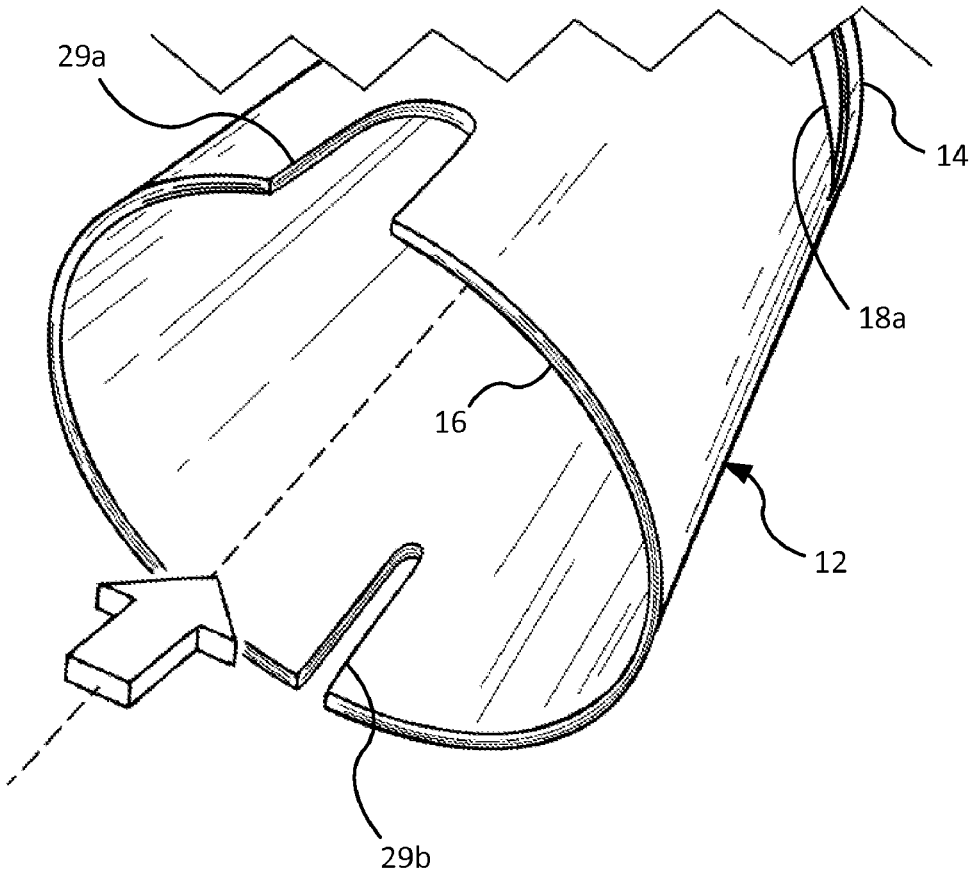
FIG. 4 is a partial perspective view of a preferred cylindrical housing for use in a preferred embodiment of the invention.
Figure 5A:
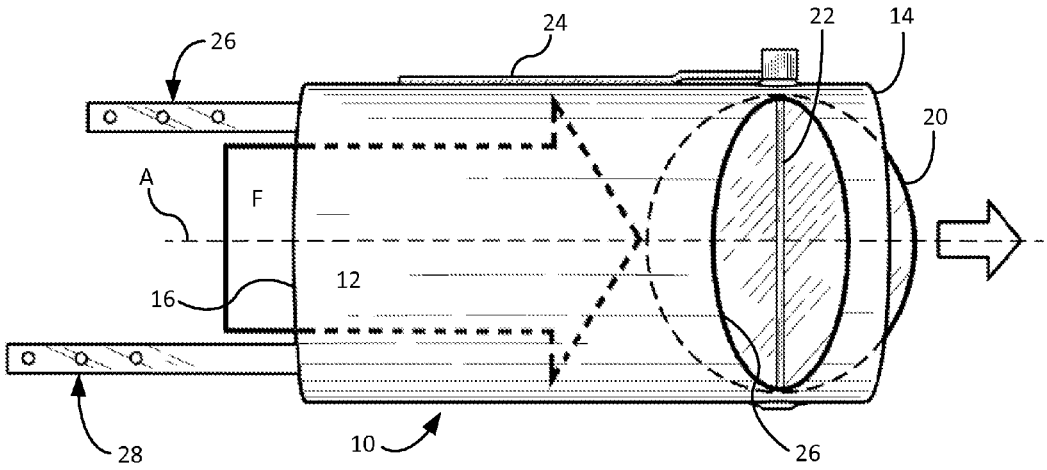
FIG. 5A is a side elevation schematic view of a preferred propulsor apparatus showing forward thrust when the diverter gate is in a central position.
Figure 5B:
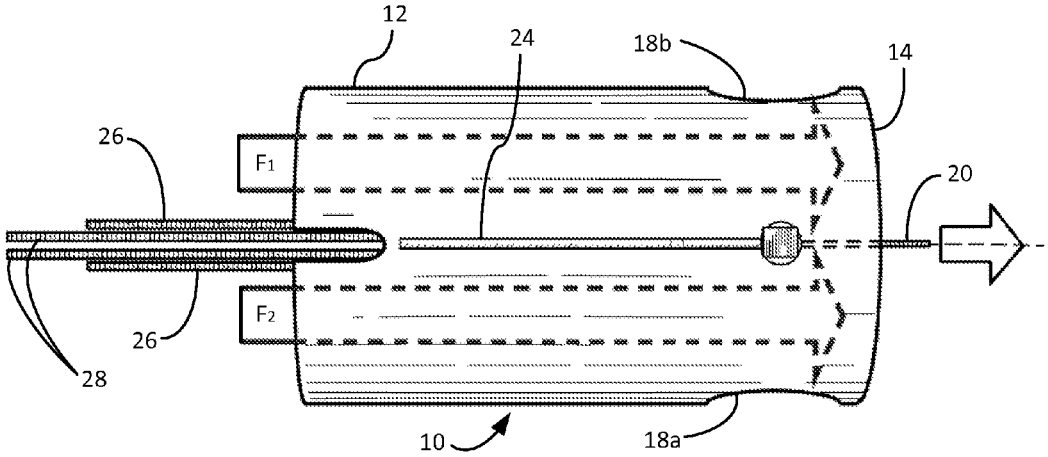
FIG. 5B is a top view of a preferred propulsor apparatus showing forward thrust when the diverter gate is in a central position.
Figure 5C:
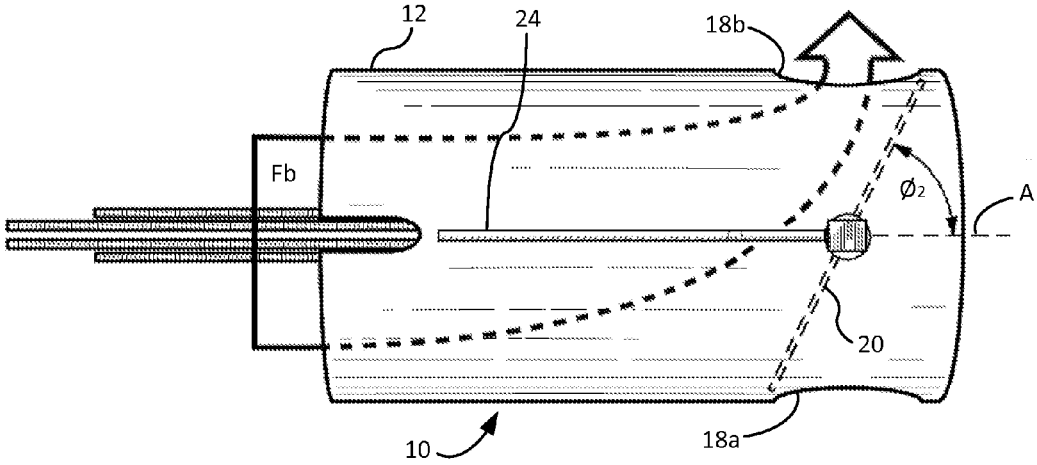
FIG. 5C is a top view of a preferred propulsor apparatus showing forward thrust when the diverter gate is in a port position.
Figure 5D:
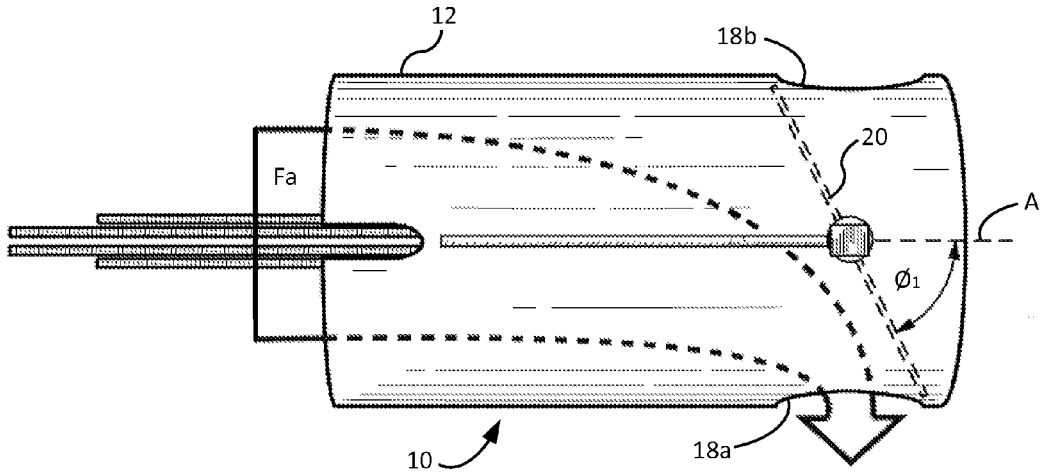
FIG. 5D is a top view of a preferred propulsor apparatus showing forward thrust when the diverter gate is in a starboard position.

With joint reference to FIGS. 1 through FIG. 5D, there is shown therein preferred embodiments of multi-directional marine propulsors of the present invention that provide fore, aft, and side to side thrust to improve boat maneuverability.

Preferred marine propulsors 10 shown in the Figures are designed for use with boats of the type having a hull H, a keel R defining a bow-stern axial direction and a motor 44 with a rotatable propeller 30. While the invention is not so limited, it is particularly well suited for use with sail boats of the type having a center keel. The propulsor may have a cylindrical thruster housing 12 with opposing fore and aft apertures 16, 14 and with opposing port and starboard apertures 18*a*, 18*b*. The fore and aft apertures preferably lie substantially aligned with the central axis. The port and starboard apertures preferably lie substantially perpendicular with the central axis. The housing 12 may define a central axis A at least substantially parallel to the bow-stern axial direction when mounted in fixed relation to the boat hull H and preferably aft of the keel. Alternatively, the propulsor may be affixed to other boat structures (such as the hull) below the waterline. For example, inventive propulsors may be mounted on a swiveling pod strut (for a raft or a barge) or on retractable landing gear (in the case of aircraft with amphibious capabilities). Further, preferred housings have an upper mounting recess 29*a* and a lower mounting recess 29*b* that are sized and shaped to receive corresponding components of a boat motor therein.

The housing may also be sized to receive the propeller 30 proximate to the fore aperture 16 such that the propeller 30 may rotate about the central axis A to thereby provide forward thrust F ($F_1$, $F_2$, $F_a$ and $F_b$) within the housing 12. Those of skill in the art will appreciate that, as shown, the preferred propeller is a turbine with a plurality of blades that are not sharp or knife-like. Rather, the turbine blades are preferably thicker with rounded edges unlike a conventional propeller. Moreover, the turbine preferably includes a plurality of apertures disposed about the central axis to reduce cavitation while the turbine rotates about the central axis. Alternatively, other propeller configuration may be selected and used with the inventive propulsor with the exercise of ordinary skill. Regardless of the particular propeller used, the inventive propulsor virtually eliminates dangerous propeller accidents that can sever fingers, toes, etc. (as may occur with conventional boat motor configurations) since the turbine or propeller is disposed within the cylindrical housing; it is, therefore, shielded from inadvertent contact. This is especially true of the alternative configuration of the invention (discussed below) in which the propulsor is mounted directly onto a boat motor. An additional benefit of the configuration described herein is that the propulsor is also relatively well protected from weeds and other submerged debris.

In addition to the housing 12, the propulsor may include some means 26, 28 for affixing the cylindrical housing 12 to the boat R, H. In the embodiment shown the housing is affixed to the boat keel using a pair of upper and a pair of lower mounting 26, 28. An elliptical diverter gate 20 may be mounted within the cylindrical housing 12 proximate the aft aperture 14 for limited rotation about a vertical control axis 22 between port, central and starboard positions. The elliptical gate is preferably wider than it is tall and is sized to effectively seal off the housing when rotated to either the port or the starboard positions at a predetermined angle $Ø_1$ or $Ø_2$ (relative to central axis A) where Ø is preferably +/−30 degrees. When the gate 20 is in a port position (FIG. 5C) substantially all of the forward thrust $F_b$ may exit the port aperture 18*b*. When the gate is in a central position (FIGS. 5A and 5B) substantially all of the forward thrust $F_1$, $F_2$ may exit the aft aperture 14. When the gate 20 is in a starboard position (FIG. 5D) substantially all of the forward thrust $F_a$ may exit the starboard aperture 18*a*. Incidentally, it will also be appreciated that the propeller may also rotate in a reverse direction about the central axis to provide reverse thrust within the housing. When this occurs and when the gate is in the central position, substantially all of the reverse thrust exits the fore aperture.

The inventive propulsor 10 may also include some means 22, 24 for rotating the diverter gate between the port, central and starboard positions which may include one or more of a diverter axle 22, a control arm 24 and/or a servo motor (not shown). A particularly advantageous feature of the present invention is that the thrust incident on the port side of the diverter gate is substantially equal (relative to the vertical diverter axis) to the thrust incident on the starboard side of the diverter gate regardless of what position the diverter gate is in. As a correlate, the thrust incident on the port side of the diverter gate is substantially equal to the thrust incident on the starboard side of the diverter gate when the diverter gate is in either of the port or starboard positions. This quality of the invention enables a relatively weak control arm and (if used) servo motor connected thereto to operate the diverter gate even though the thrust provided by the motor may be quite substantial. As a consequence these components may be relatively inexpensive without sacrificing quality and/or reliability.

In a particularly preferred embodiment, drive assembly 40 may include an electric motor 44 mounted on a shaft 42 which is, in turn, mounted through hull H with a compression seal 48 as is known in the art. Power for motor 44 may be provided by wire/conductors 46. This configuration locate motor 44 at least partially disposed within the housing 12 and the motor may be affixed to or simply at least partially received with recesses 29*a* and 29*b* as desired. The means for affixing comprises upper and lower mounting recesses in the cylindrical housing within which the motor is at least partially received. Alternative embodiments contemplate the use of internal combustion engines for marine applications such as conventional outboard, inboard and inboard/outboard motors either used exactly as known or modified using ordinary skill in the art.

The various components of the inventive propulsor such as the cylindrical housing and the diverter gate may be formed of rigid material and most preferably non-corrosive metals as are well known in the marine arts.

In an alternative embodiment, the invention provides a multi-directional marine propulsor apparatus 10 designed to be mounted directly onto a boat motor 44 having a rotatable propeller 30. The propulsor 10 may be substantially similar to the boat-mounted propulsor as described above except that housing 12 may define a central axis A when mounted in fixed relation to the boat motor 44 and may be sized to receive the propeller 30 proximate to the fore aperture such that the propeller may rotate about the central axis within the housing. Additionally, the propulsor may also include some means for affixing the cylindrical housing 12 directly onto the motor 44 rather than the keel R.

As used herein, "rigid" generally means incapable of substantial deformation without a tendency to break and/or with no tendency to return to its original form.

For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

While the present invention has been described in connection with what is presently considered to be the most practical and preferred embodiments, it is to be understood that the invention is not limited to the disclosed embodiments, but is intended to encompass the various modifications and equivalent arrangements included within the spirit and scope of the appended claims. With respect to the above description, for example, it is to be realized that the optimum dimensional relationships for the parts of the invention, including variations in size, materials, shape, form, function and manner of operation, assembly and use, are deemed readily apparent to one skilled in the art, and all equivalent relationships to those illustrated in the drawings and described in the specification are intended to be encompassed by the appended claims. Therefore, the foregoing is considered to be an illustrative, not exhaustive, description of the principles of the present invention.

What is claimed is:

1. A multi-directional marine propulsor apparatus for use with a boat of the type having a hull, a keel defining a bow-stern axial direction and a motor with a rotatable propeller, the propulsor apparatus comprising:

a cylindrical thruster housing with opposing fore and aft apertures and with opposing port and starboard apertures, the housing defining a central axis at least substantially parallel to the bow-stern axial direction when mounted in fixed relation to the boat hull, the housing also being sized to receive the propeller proximate to the fore aperture such that the propeller may rotate about the central axis to thereby provide forward thrust within the housing;

means for affixing the cylindrical housing to the boat;

a non-circular elliptical diverter gate mounted within the cylindrical housing proximate the aft aperture for limited rotation about a vertical control axis between port, central and starboard positions such that substantially all of the forward thrust exits the port aperture when the gate is in the port position, such that substantially all of the forward thrust exits the aft aperture when the gate is in the central position, and such that substantially all of the forward thrust exits the starboard aperture when the gate is in the starboard position, and means for rotating the diverter gate between the port, central and starboard positions.

2. The propulsor apparatus of claim 1, wherein the elliptical diverter gate is wider in the horizontal direction than it is tall in the vertical direction.

3. The propulsor apparatus of claim 1, wherein the thrust incident on the port side of the diverter gate is substantially equal to the thrust incident on the starboard side of the diverter gate regardless of what position the diverter gate is in.

4. The propulsor apparatus of claim 1, wherein the cylindrical housing is mounted to the keel, wherein the propeller may also rotate about the central axis to provide reverse thrust within the housing, and wherein substantially all of the reverse thrust exits the fore aperture when the gate is in the central position.

5. The propulsor apparatus of claim 1, wherein the means for rotating the diverter gate comprises a vertical diverter axle and a control arm oriented at least substantially perpendicular to the diverter axle.

6. The propulsor apparatus of claim 5, wherein the boat is a sailboat, wherein the motor is a component of a drive assembly that is mounted through the boat hull and wherein the means for rotating the diverter gate further comprises a servo motor.

7. The propulsor apparatus of claim 1, wherein the propeller is a turbine with a plurality of apertures disposed about the central axis to reduce cavitation while the turbine rotates about the central axis.

8. The propulsor apparatus of claim 1, wherein the diverter gate is oriented about +/−30 degrees relative to the central axis when the diverter gate is in either of the port or starboard positions.

9. The propulsor apparatus of claim 1, wherein the means for affixing the cylindrical housing to the boat comprises a plurality of brackets extending fore of the housing and affixed to aft side of the keel of the boat.

10. The propulsor apparatus of claim 1, wherein the boat motor comprises an electric motor that is at least partially disposed within the cylindrical housing and wherein the means for affixing comprises upper and lower mounting recesses in the cylindrical housing within which the motor is at least partially received.

11. The propulsor apparatus of claim 1, the cylindrical housing and the diverter gate are formed of rigid material.

12. A multi-directional marine propulsor apparatus for use with a boat motor having a rotatable propeller, the propulsor apparatus comprising:

a cylindrical thruster housing with opposing fore and aft apertures and with opposing port and starboard apertures, the housing defining a central axis when mounted in fixed relation to the boat motor, the housing also being sized to receive the propeller proximate to the fore aperture such that the propeller may rotate about the central axis within the housing to thereby provide forward thrust within the housing;

means for affixing the cylindrical housing to the motor;

a non-circular elliptical diverter gate mounted within the cylindrical housing proximate the aft aperture for limited rotation about a vertical control axis between port, central and starboard positions such that substantially all of the forward thrust exits the port aperture when the gate is in the port position, such that substantially all of the forward thrust exits the aft aperture when the gate is in the central position, and such that substantially all of the forward thrust exits the starboard aperture when the gate is in the starboard position, and means for rotating the diverter gate between the port, central and starboard positions.

13. The propulsor apparatus of claim 12, wherein the elliptical diverter gate is wider in the horizontal direction than it is tall in the vertical direction.

14. The propulsor apparatus of claim 12, wherein the thrust incident on the port side of the diverter gate is substantially equal to the thrust incident on the starboard side of the diverter gate regardless of what position the diverter gate is in.

15. The propulsor apparatus of claim 12, wherein the means for rotating the diverter gate comprises a vertical diverter axle and a control arm oriented at least substantially perpendicular to the diverter axle.

16. The propulsor apparatus of claim 15, wherein the means for rotating the diverter gate further comprises a servo motor.

17. The propulsor apparatus of claim 12, wherein the propeller is a turbine with a plurality of apertures disposed about the central axis to reduce cavitation while the turbine rotates about the central axis.

18. The propulsor apparatus of claim 12, wherein the diverter gate is oriented about +/−30 degrees relative to the central axis when the diverter gate is in either of the port or starboard positions.

19. The propulsor apparatus of claim 12, the cylindrical housing and the diverter gate are formed of rigid material.

20. The propulsor apparatus of claim 12, wherein the means for affixing comprises upper and lower mounting recesses in the cylindrical housing within which the motor is at least partially received.

* * * * *